United States Patent [19]

Kiesling

[11] 4,292,945

[45] Oct. 6, 1981

[54] FUEL INJECTION APPARATUS AND SYSTEM

[75] Inventor: Norbert W. Kiesling, Mount Clemens, Mich.

[73] Assignee: Colt Industries Operating Corp, New York, N.Y.

[21] Appl. No.: 146,135

[22] Filed: May 2, 1980

[51] Int. Cl.[3] ..... F02B 33/00

[52] U.S. Cl. ..... 123/438; 123/440

[58] Field of Search ..... 123/437, 438, 440, 472

[56] References Cited

U.S. PATENT DOCUMENTS 2,428,377 10/1947 Morris ..... 123/437

4,132,203 1/1979 Elpern ..... 123/139 AW

*Primary Examiner*—Ronald B. Cox

*Attorney, Agent, or Firm*—Walter Potoroka, Sr.

[57] ABSTRACT

A fuel metering apparatus is shown as having a throttle body with an induction passage therethrough and a throttle valve for controlling flow through the induction passage, a fuel-air mixture discharge member is situated generally in the induction passage downstream of the throttle valve, an air passage communicates between a source of air and the fuel-air mixture discharge member, the air passage also includes a flow restrictor therein which provides for sonic flow therethrough, and a fuel metering valving assembly is effective for metering liquid fuel at a superatmospheric pressure and delivering such metered liquid fuel into the air passage upstream of the flow restrictor thereby causing the thusly metered liquid fuel and air to pass through the sonic flow restrictor before being discharged into the induction passage by the fuel-air mixture discharge member.

4 Claims, 2 Drawing Figures

FUEL INJECTION APPARATUS AND SYSTEM

FIELD OF INVENTION

This invention relates generally to fuel injection systems and more particularly to fuel injection systems and apparatus for metering fuel flow to an associated combustion engine.

BACKGROUND OF THE INVENTION

Even though the automotive industry has over the years, if for no other reason than seeking competitive advantages, continually exerted efforts to increase the fuel economy of automotive engines, the gains continually realized thereby have been deemed by various levels of government as being insufficient. Further, such levels of government have also arbitrarily imposed regulations specifying the maximum permissible amounts of carbon monoxide (CO), hydrocarbons (HC) and oxides of nitrogen ($NO_x$) which may be emitted by the engine exhaust gases into the atmosphere.

Unfortunately, generally, the available technology employable in attempting to attain increases in engine fuel economy is contrary to that technology employable in attempting to meet the governmentally imposed standards on exhaust emissions.

For example, the prior art in trying to meet the standards for $NO_x$ emissions has employed a system of exhaust gas recirculation whereby at least a portion of the exhaust gas is reintroduced into the cylinder combustion chamber to thereby lower the combustion temperature therein and consequently reduce the formation of $NO_x$.

The prior art has also proposed the use of engine crank-case recirculation means whereby the vapors which might otherwise become vented to the atmosphere are introduced into the engine combustion chambers for further burning.

The prior art has also proposed the use of fuel metering means which are effective for metering a relatively overly rich (in terms of fuel) fuel-air mixture to the engine combustion chamber means as to thereby reduce the creation of $NO_x$ within the combustion chamber. The use of such overly rich fuel-air mixtures results in a substantial increase in CO and HC in the engine exhaust which, in turn, requires the supplying of additional oxygen, as by an associated air pump, to such engine exhaust in order to complete the oxidation of the CO and HC prior to its delivery into the atmosphere.

The prior art has also heretofor proposed employing the retarding of the engine ignition timing as a further means for reducing the creation of $NO_x$. Also, lower engine compression ratios have been employed in order to lower the resulting combustion temperature within the engine combustion chamber and thereby reduce the creation of $NO_x$. In this connection the prior art has employed what is generally known as a dual bed catalyst. That is, a chemically reducing first catalyst is situated in the stream of exhaust gases at a location generally nearer the engine while a chemically oxidizing second catalyst is situated in the stream of exhaust gases at a location generally further away from the engine and downstream of the first catalyst. The relatively high concentrations of CO resulting from the overly rich fuel-air mixture are used as the reducing agent for $NO_x$ in the first catalyst while extra air supplied (as by an associated pump) to the stream of exhaust gases, at a location generally between the two catalysts, serves as the oxidizing agent in the second catalyst. Such systems have been found to have various objections in that, for example, they are comparatively very costly requiring additional conduitry, air pump means and an extra catalyst bed. Further, in such systems, there is a tendency to form ammonia which, in turn, may or may not be reconverted to $NO_x$ in the oxidizing catalyst bed.

The prior art has also proposed the use of fuel metering injection means for eliminating the usually employed carbureting apparatus and, under superatmospheric pressure, injecting the fuel through individual nozzles directly into the respective cylinders of a piston type internal combustion engine. Such fuel injection systems, besides being costly, have not proven to be generally successful in that the system is required to provide metered fuel flow over a very wide range of metered fuel flows. Generally, those prior art injection systems which are very accurate at one end of the required range of metered fuel flows, are relatively inaccurate at the opposite end of that same range of metered fuel flows. Also, those prior art injection systems which are made to be accurate in the mid-portion of the required range of metered fuel flows are usually relatively inaccurate at both ends of that same range. The use of feedback means for altering the metering characteristics of such prior art fuel injection systems has not solved the problem of inaccurate metering because the problem usually is intertwined within such factors as: effective aperture area of the injector nozzle; comparative movement required by the associated nozzle pintle or valving member; inertia of the nozzle valving member; and nozzle "cracking" pressure (that being the pressure at which the nozzle opens). As should be apparent, the smaller the rate of metered fuel flow desired, the greater becomes the influence of such factors thereon.

It is now anticipated that the said various levels of government will be establishing even more stringent exhaust emission limits.

The prior art, in view of such anticipated requirements, with respect to $NO_x$, has suggested the employment of a "three-way" catalyst, in a single bed, within the stream of exhaust gases as a means of attaining such anticipated exhaust emission limits. Generally, a "three-way" catalyst is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel) the $NO_x$ will be reduced effectively but the oxidation of CO will be incomplete; if the fuel metering is too lean, the CO will be effectively oxidized but the reduction of $NO_x$ will be incomplete. Obviously, in order to make such a "three-way" catalyst system operative, it is necessary to have very accurate control over the fuel metering function of the associated fuel metering supply means feeding the engine. As hereinbefore described, the prior art has suggested the use of fuel injection means, employing respective nozzles for each engine combustion chamber, with associated feedback means (responsive to selected indicia of engine operating conditions and parameters) intended to continuously alter or modify the metering characteristics of the fuel injection means. However, as also hereinbefore indicated, such fuel injection systems have not proven to be successful.

It has also heretofore been proposed to employ fuel metering means, of a carbureting type, with feedback means responsive to the presence of selected constituents comprising the engine exhaust gases. Such feedback means were employed to modify the action of a main metering rod of a main fuel metering system of a carburetor. However, tests and experience have indicated that such a prior art carburetor and such a related feedback means can never provide the degree of accuracy required in the metering of fuel to an associated engine as to assure meeting, for example, the said anticipated exhaust emission standards.

Accordingly, the invention as disclosed and described is directed, primarily to the solution of such and other related and attendant problems of the prior art.

SUMMARY OF THE INVENTION

According to the invention, a fuel metering apparatus and system employs a throttle body with induction passage means therethrough and a throttle valve for controlling flow through the induction passage means, fuel under superatmospheric pressure is supplied to a sonic nozzle-like structure which, in turn, delivers the metered fuel as to annular discharge orifice means situated within the induction passage means downstream of the throttle valve, air is also supplied to the metered fuel upstream of the sonic nozzle-like structure as to at idle engine speed and at least most subsequent engine speeds flow sonically therethrough.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted.

DETAILED DESCRIPTION OF THE PREFERRED EMBODIMENT

Figure 1:
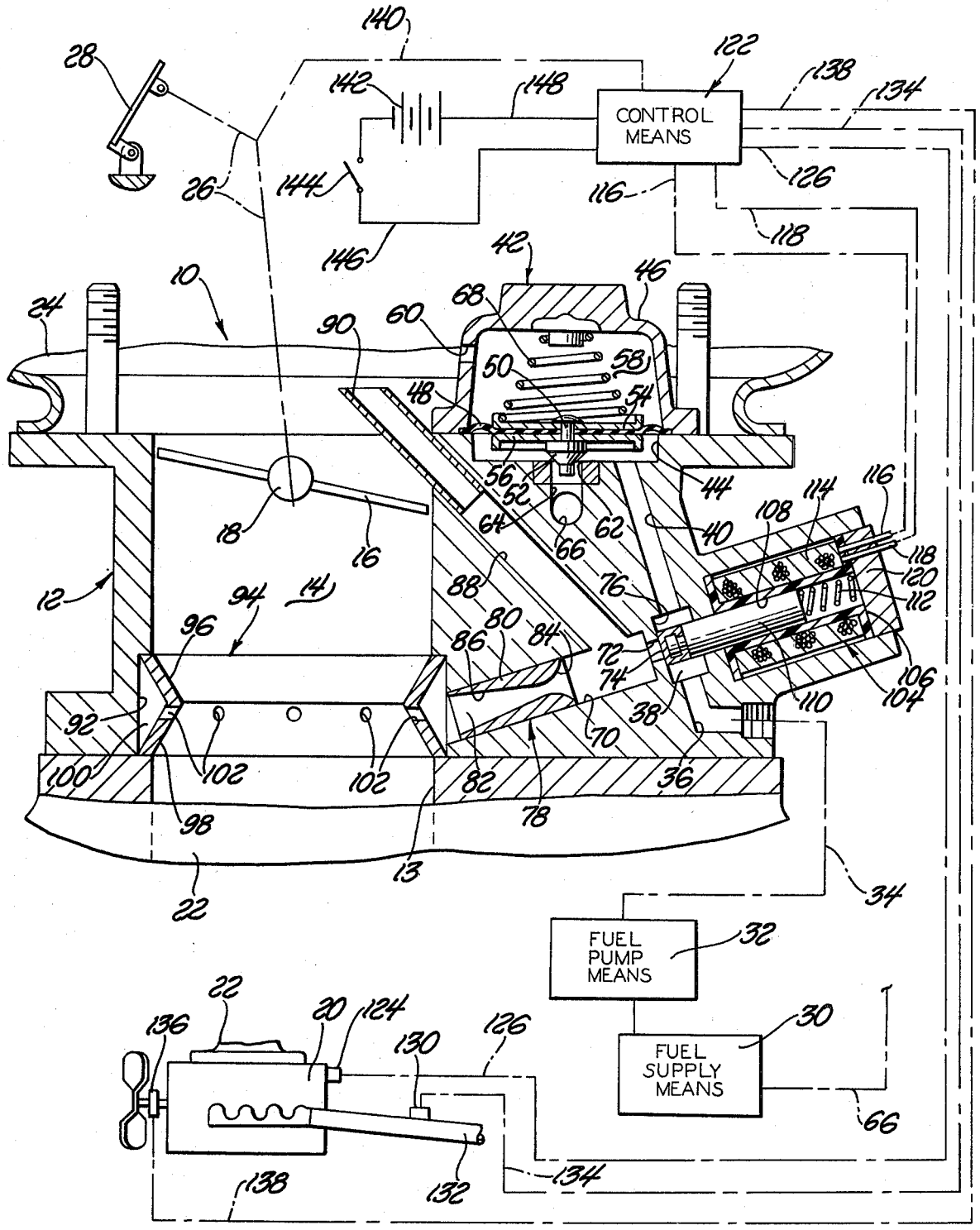
FIG. 1 illustrates in cross-section one form of the fuel injection apparatus and system employing teachings of the invention.

Referring now in greater detail to the drawings, FIG. 1 illustrates fuel injection apparatus 10 and system comprised as of induction body or housing means 12 having induction passage means 14 wherein a throttle valve 16 is situated and carried as by a rotatable throttle shaft 18 for rotation therewith thereby variably restricting the flow of air through the induction passage means 14 and into the engine 20 as via associated engine intake manifold means 22. If desired suitable air cleaner means may be provided as to generally emcompass the inlet of induction passage means 14 as generally fragmentarily depicted at 24. The throttle valve means 16 may be suitably operatively connected as through related linkage and motion transmitting means 26 to the operator positioned throttle control means which, as generally depicted, may be the operator foot-operated throttle pedal or lever 28 as usually provided in automotive vehicles.

A source of fuel as, for example, a vehicular gasoline tank 30, supplies fuel to associated fuel pumping means 32 which, in turn, delivers unmetered fuel as via conduit means 34 to conduit means 36 leading as to a chamber portion 38 which, in turn, communicates with passage or conduit means 40 leading to pressure regulator means 42. As generally depicted, the pressure regulator means 42 may comprise a recess or chamber like portion 44 formed in body 12 and a cup-like cover member 46. A deflectable diaphragm 48, operatively secured as to the stem portion 50 of a valving member 52 as through opposed diaphragm backing plates 54 and 56, is generally peripherally contained and retained between cooperating portions of body 12 and cover 46 as to thereby define variable and distinct chambers 44 and 58 with chamber 58 being vented as to a source of ambient atmospheric pressure as through vent or passage means 60. A valve seat or orifice member 62 cooperates with valving member 52 for controllably allowing flow of fuel therebetween and into passage means 64 and fuel return conduit means 66 which, as depicted, preferably returns the excess fuel to the fuel supply means 30. Spring means 68 situated as within chamber means 58 operatively engages diaphragm means 48 and resiliently urges valving member 52 closed against valve seat 62.

Generally, unmetered fuel may be provided to conduit means 36 and chamber 38 at a pressure of slightly in excess of 10.0 p.s.i. Passage 40 communicates such pressure to chamber 44 where acts against diaphragm 48 and spring means 68 which are selected as to open valving member 52 in order to thereby vent some of the fuel and pressure as to maintain an unmetered fuel pressure of 10.0 p.s.i.

Chamber 38 is, at times, placed in communication with metered fuel passage means 70 as through metered fuel orifice means 72. As depicted, a metering valving member 74 is adapted to at times be seated as against a suitable seating surface 76 thereby terminating fuel flow from chamber 38 through passage means 72 and into passage means 70. Passage means 70 may also contain therein venturi means 78 which may take the form of an insert like member having a body 80 with a venturi passage 82 formed therethrough as to have a converging inlet or upstream surface portion 84 leading to a venturi throat from which a diffuser surface portion 86 extends downstream. A conduit 88 having one end 90 communicating as with a source of ambient atmosphere has its other end communicating with metered fuel passage means 70 as at a point or area upstream of venturi restriction means 78 and, generally, downstream of metered fuel passage means 72.

A counterbore or annular recess 92 in body means 12 closely receives therein an annular or ring-like member 94 which, preferably, has an upper or upstream annular body portion 96 which converges and a lower or downstream annular body portion 98 which diverges. The coacting converging and diverging wall portions of annular member 94, in turn, cooperate with recess 92 to define therebetween an annulus or annular space 100 which communicates with metered fuel passage means 70 and the downstream or outlet end of restriction means 78. Preferably a plurality of discharge orifice means 102 are formed, in angularly spaced relationship, in annular member 94 as to be generally circumferentially thereabout. Further, preferably, such discharge orifice means are formed in the downstream diverging portion 98 as to be at or below the general area of juncture between upstream and downstream annular portions 96 and 98.

Valve member 74 is illustrated as comprising a portion of an overall oscillator type valving means or assembly 104 which is depicted as comprising a spool-like bobbin 106 having inner passage means 108 slidably receiving therein an armature means 110, carrying valve member 74, and spring means 112 yieldingly urging armature 110 and valve member 74 generally toward the left and into seated engagement with valve seat means 76 terminating communication of chamber 38 with passage or conduit means 72. A field or solenoid winding or coil 114 is carried by the bobbin 106 and has its opposite electrical ends connected as to electrical conductors 116 and 118 which may pass through suitable closure means 120 and be electrically connected as to related control means 122. The practice of the invention is not limited to, for example, a particular fuel metering means; however, in the preferred embodiment, the metering valving means 104 is of the duty cycle type wherein the winding 114 is intermittently energized thereby causing, during such energization, armature 110 and valve member 74 to move in a direction away from valve orifice 72 or valve seat 76. As should be apparent, with such a duty-cycle type metering solenoid assembly the effective flow area of valve orifice or passage 72 can be variably and controllably determined by controlling the frequency and/or duration of the energization of coil means 114.

The control means 122 may comprise, for example, suitable electronic logic type control and power outlet means effective to receive one or more parameter type input signals and in response thereto produce related outputs. For example, engine temperature responsive transducer means 124 may provide a signal via transmission means 126 to control means 122 indicative of the engine temperature; sensor means 130 may sense the relative oxygen content of the engine exhaust gases (as within engine exhaust conduit means 132) and provide a signal indicative thereof via transmission means 134 to control means 122; engine speed responsive transducer means 136 may provide a signal indicative of engine speed via transmission means 138 to control means 122 while engine load, as indicated for example by throttle valve 16 position, may provide a signal as via transmission means 140 to control means 122. A source of electrical potential 142 along with related switch means 144 may be electrically connected as by conductor means 146 and 148 to control means 122.

OPERATION OF INVENTION

Generally, in the embodiment disclosed, fuel under pressure is supplied as by fuel pump means 32 to conduit 36 and chamber 38 (and regulated as to its pressure by regulator means 42) and such fuel is metered through the effective metering area of valve orifice means 72 to conduit portion 70 from where such metered fuel flows through restriction means 78 and into annulus 100 and ultimately through discharge port means 102 and to the engine 20. The rate of metered fuel flow, in the embodiment disclosed, will be dependent upon the relative percentage of time, during an arbitrary cycle time or elapsed time, that the valve member 74 is relatively close to or seated against orifice seat 76 as compared to the percentage of time that the valve member 74 is relatively far away from the cooperating valve seat 76.

This, in turn, is dependent on the output to coil 114 from control means 122 which, in turn, is dependent on the various parameter signals received by the control means 122. For example, if the oxygen sensor and transducer means 130 senses the need of a further fuel enrichment in the motive fluid being supplied to the engine and transmits a signal reflective thereof to the control means 122, the control means 122, in turn, will require that the metering valve 74 be opened a greater percentage of time as to provide the necessary increased rate of metered fuel flow. The practice of the invention is not limited to a particular form of fuel metering means or to a particular system for the control of such fuel metering means. Accordingly, it will be understood that given any selected parameters and/or indicia of engine operation and/or ambient conditions, the control means 122 will respond to the signals generated thereby and respond as by providing appropriate energization and de-energization of coil means 114 (causing corresponding movement of valve member 74) thereby achieving the then required metered rate of fuel flow to the engine.

The prior art has employed relatively high pressures both upstream and downstream of the fuel metering means in an attempt to obtain sufficient fuel atomization within the induction passage means. Such have not proven to be successful.

It has been discovered that the invention provides excellent fuel atomization characteristics even when the upstream unmetered fuel pressure is in the order of 10.0 p.s.i. (the prior art often employing upstream unmetered fuel pressures in the order of 40.0 p.s.i.). The invention achieves this by providing a high velocity air stream into which all the metered fuel is injected, mixed and atomized and subsequently delivered to the engine induction passage.

That is, more particularly, conduit means 88 supplies all of the air needed to sustain idle engine operation when the throttle valve means 16 is closed. As can be seen a flow circuit is described by inlet 90 of conduit 88, conduit 88, passage means 70, passage means 82, annulus 100, orifice means 102 and engine intake manifold induction passage means 13; such provides all of the air flow to the engine 20 required for idle engine operation. The restriction means 78 is of a size as to result in the flow through passage 82 being sonic during idle engine operation. The fuel which is metered by valve member 74 and injected into passage 70 mixes with the air as the metered fuel and air flow into inlet 84 of venturi nozzle-like means 78 and become accelerated to sonic velocity. The fuel within such fuel-air mixtures becomes atomized as it undergoes acceleration to sonic velocity and subsequent expansion in portion 86 of venturi means 78. The atomized fuel-air mixture then passes into annulus 100 and is discharged, generally circumferentially of induction passage means 14, through the discharge port means 102 of diffuser means 94 and into passage means 13 of engine 20. In the preferred embodiment of the invention, the restriction means 78 not only provides for sonic flow therethrough during idle engine operation but also provides for sonic flow therethrough during conditions of engine operation other than idle and, preferably, over at least most of the entire range of engine operation.

When further engine power is required, throttle valve means 16 is opened to an appropriate degree and the various related parameter sensing means create input signals to control means 122 resulting in fuel metering means 104 providing the corresponding increase in the rate of metered fuel to the passage 70 and, as hereinbefore described, ultimately to engine 20.

As should be apparent, suitable temperature responsive means may be provided in order to slightly open throttle valve 16 during cold engine idle operation in order to thereby assist in sustaining such cold engine idle operation and preclude rough engine operation.

Figure 2:
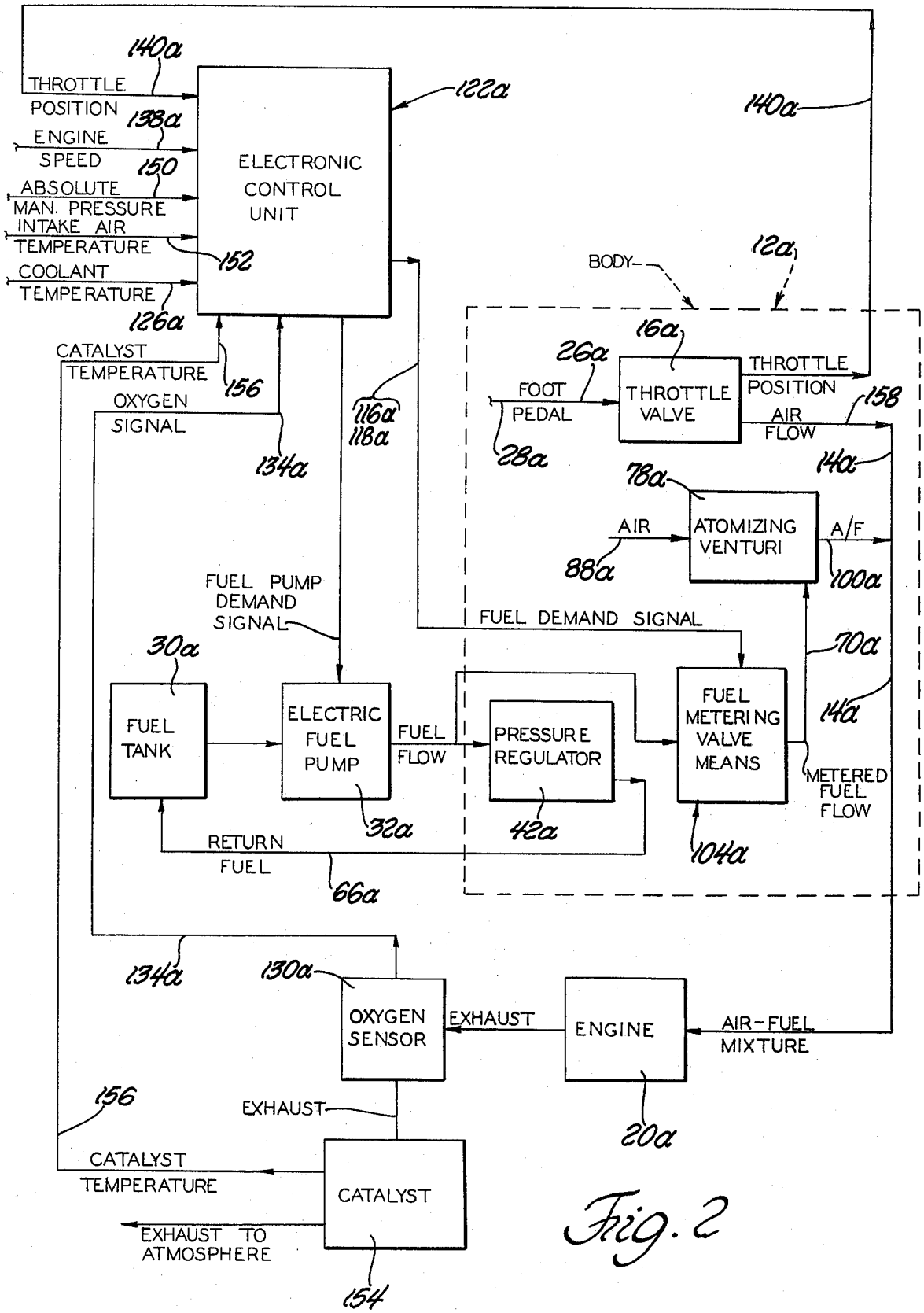
FIG. 2 is a block diagram of an entire fuel metering system as may be applied to or employed in combination with the fuel injection apparatus of FIG. 1.

FIG. 2 illustrates in general block diagram the invention of FIG. 1 along with other contemplated operating parameter and indicia sensing means for creating related inputs to the control means which, as generally identified in FIG. 2, may be an electronic control unit. For ease of reference, elements in FIG. 2 which correspond to those of FIG. 1 are identified with like reference numbers provided with a suffix "a".

As generally depicted in FIG. 2 the electronic control or logic means 122*a* is illustrated as receiving input signals, as through suitable transducer means, reflective and indicative of various engine operating parameters and indicia of engine operation. For example, it is contemplated that the electronic logic or control means 122*a* would receive, as inputs, signals of the position of the throttle valve means 16*a* as via transducer or transmission means 140*a;* the magnitude of the engine speeds as by transducer or transmission means 138*a;* the magnitude of the absolute pressure within the engine intake manifold 22 as by transducer or transmission means 150; the temperature of the air at the inlet of the induction system as by transducer or transmission means 152; the magnitude of the engine 20*a* coolant system temperature as via transducer or transmission means 126; the magnitude of the engine exhaust catalyst 154 temperature as by transducer or transmission means 156; and the percentage of oxygen (or other monitored constituents) in the engine exhaust as by transducer or transmission means 134.

In considering both FIGS. 1 and 2 it can be seen that the electronic control means 122*a,* upon receiving the various input signals, creates a first output signal as along conductor means 116*a* and 118*a* thereby energizing fuel metering valving means 104*a.* If the operator should open throttle valve means 16*a,* as through pedal 28*a* and linkage or transmission means 26*a,* the new position thereof is conveyed to the control means 122*a* and an additional rate of air flow 158 is permitted into the induction passage means 14*a* as to become commingled with the motive fluid being discharged by the nozzle means 94.

In any event, the fuel-air mixture is introduced into the engine 20*a* (as via intake manifold means 22) and upon being ignited and performing its work is emitted as exhaust. An oxygen sensor, or the like, 130*a* monitors the engine exhaust gases and in accordance therewith creates an output signal via transducer means 134*a* to indicate whether the exhaust gases are overly rich, in terms of fuel, too lean, in terms of fuel, or exactly the proper ratio. The electronic control means, depending upon the nature of the signal received from the oxygen sensor 134*a,* produces an output signal as via conductor means 116*a* and 118*a* for either continuing the same duty cycle of fuel metering valve means 104*a* or altering such as to obtain a corrected duty cycle and corresponding altered rate of metered fuel flow. Generally, each of such input signals (varying either singly or collectively) to the electronic control means (except such as will be noted to the contrary) will, in turn, cause the electronic control means 122*a* to produce an appropriate signal to the fuel metering valve assembly 104*a.*

As is also best seen in FIG. 2, in the preferred embodiment, a fuel supply or tank 30*a* supplies fuel to the inlet of a fuel pump 32*a* (which may be electrically driven and actually by physically located within the fuel tank means 30*a*) which supplies unmetered fuel to suitable pressure regulator means 42*a* which is generally in parallel with fuel metering valving assembly 104*a.* Return conduit means 66*a* serves to return excess fuel as to the inlet of pump means 32*a* or, as depicted, to the fuel tank means 30*a.* Fuel, unmetered, at a regulated pressure is delivered via conduit means 36 to the upstream side of the effective fuel metering orifice as determined by orifice means 72 and coacting valving member 74.

In practicing the invention, it is contemplated that certain fuel metering functions will be performed in an open loop manner as a fuel schedule which, in turn, is a function of one or more input signals to the control means 122*a.* For example, it is contemplated that acceleration fuel could be supplied and metered by the fuel metering valving assembly 104*a* as a function of the position of throttle valve means 16*a* and the rate of change of position of such throttle valve means 16*a* while the engine cranking or starting fuel and cold engine operation fuel metering schedule would be a function of engine temperature, engine speed and intake manifold pressure. Further, it is contemplated that open loop scheduling of metered fuel flow would be employed during catalytic converter warm-up and for maximum engine power as at wide open throttle conditions as well as being employed during and under any other conditions considered necessary or desirable.

Although only a preferred embodiment and selected modifications of the invention have been disclosed and described, it is apparent that other embodiments and modifications of the invention are possible within the scope of the appended claims.

What is claimed is:

1. Fuel metering apparatus for supplying metered rates of fuel flow to a combustion engine, comprising body means, induction passage means formed through said body means for supplying motive fluid to said engine, throttle valve means situated in said induction passage means for variably controlling the rate of flow of air through said induction passage means, fuel-air mixture discharge means situated in said induction passage means downstream of said throttle valve means, air passage means communicating between a source of air and said fuel-air mixture discharge means, said air passage means comprising flow restriction means, said flow restriction means being calibrated as to provide for sonic flow therethrough at conditions of idle engine operation, fuel metering means for metering liquid fuel in response to engine demands and indicia of engine operation, said liquid fuel when metered by said fuel metering means being discharged into said air passage means at an area thereof downstream of said source of air and upstream of said flow restriction means, said flow restriction means comprising sonic venturi type restriction means, said fuel metering means for metering liquid fuel comprising a duty-cycle type metering solenoid assembly, said metering solenoid assembly comprising armature means, a valve member operatively carried by said armature means, and a field winding, said field winding being intermittently energizable during metering of said liquid fuel as to cause said armature means and said valve member to move toward and away from a closed position and thereby result in an average rate of flow of fuel past said valve member which constitutes the then metered rate of liquid fuel flow, unmetered fuel passage means for supplying unmetered fuel to said fuel metering means upstream of said fuel metering means, pressure regulator means operatively communicating with said unmetered fuel for regulating the pressure thereof to a reselected superatmospheric magnitude, said fuel-air mixture discharge means comprising generally annular means defining generally annular passage means, said air-passage means in communicating with said fuel-air mixture discharge means communicates with said generally annular passage means, and discharge port means communicating between said generally annular passage means and said induction passage means for directing the flow of the fuel-air mixture within said generally annular passage means to said induction passage means, said discharge port means comprising a plurality of discharge ports spaced from each other and directed generally radially inwardly of said induction passage means.

2. Fuel metering apparatus according to claim 1 wherein said sonic venturi restriction means comprises an upstream situated converging section and a downstream situated diffuser section, wherein said diffuser section comprises a downstream end, and wherein said downstream end is situated in said air passage means at a location as not to extend into said induction passage means.

3. Fuel metering apparatus according to claim 1 wherein said annular means defining generally annular passage means comprises a ring-like body member, said ring-like body member comprising radially inner generally annular surface means and radially outer generally annular surface means, said inner surface means comprising relatively upstream situated generally conical converging first surface means and relatively downstream situated generally conical diverging second surface means, said first and second surface means generally cooperating to define a throat-like region, wherein said body means comprises additional surface means defining recess means generally circumscribing said induction passage means and intersecting said air passage means, wherein said ring-like body member is at least partly received within said recess means, and wherein said radially outer generally annular surface means and said additional surface means cooperate to define said annular passage means.

4. Fuel metering apparatus according to claim 24 wherein said sonic venturi restriction means comprises an upstream situated converging section and a downstream situated diffuser section, wherein said diffuser section comprises a downstream end, and wherein said downstream end is situated in said air passage means at a location as not to extend into said induction passage means.

* * * * *